United States Patent [19]

Doughty

[11] 4,440,999

[45] Apr. 3, 1984

[54] MEMBRANE SWITCH

[75] Inventor: John I. Doughty, White Bear Lake, Minn.

[73] Assignee: Press On, Inc., Stillwater, Minn.

[21] Appl. No.: 407,821

[22] Filed: Aug. 13, 1982

[51] Int. Cl.[3] ..... H01H 9/00

[52] U.S. Cl. ..... 200/5 A; 200/159 B

[58] Field of Search ..... 200/159 B, 310, 311, 200/314, 317, 5 A

[56] References Cited

U.S. PATENT DOCUMENTS

| | | | |
|---|---|---|---|
| Re. 28,365 | 3/1975 | Braue | 200/86 |
| 3,705,276 | 12/1972 | Seeger et al. | 200/5 |
| 3,721,778 | 3/1973 | Seeger et al. | 200/5 |
| 3,773,998 | 11/1973 | Seeger et al. | 200/159 |
| 3,780,237 | 12/1973 | Seeger et al. | 200/5 |
| 3,789,167 | 1/1974 | Seeger et al. | 200/5 |
| 3,860,771 | 1/1975 | Lynn et al. | 200/5 |
| 3,862,381 | 1/1975 | Glaister et al. | 200/5 |
| 3,862,382 | 1/1975 | Glaister et al. | 200/5 |
| 3,879,593 | 4/1975 | Larson | 200/159 |
| 3,950,846 | 4/1976 | Johnson | 29/630 |
| 3,959,610 | 5/1976 | Finnegan et al. | 200/5 |
| 3,968,336 | 7/1976 | Johnson | 200/5 |
| 3,978,297 | 8/1976 | Lynn et al. | 200/5 |
| 4,017,697 | 4/1977 | Larson | 200/5 |
| 4,028,509 | 6/1977 | Zurcher | 200/5 A |
| 4,035,593 | 7/1977 | Riniker | 200/5 |
| 4,046,975 | 9/1977 | Seeger | 200/5 |
| 4,055,735 | 10/1977 | Eachus et al. | 200/5 |
| 4,056,699 | 11/1977 | Jordan | 200/5 |
| 4,066,851 | 1/1978 | White et al. | 200/5 |
| 4,066,854 | 1/1978 | Zenk et al. | 200/5 |
| 4,078,257 | 3/1978 | Bagley | 364/900 |
| 4,090,045 | 5/1978 | Marsh | 200/5 |
| 4,096,364 | 6/1978 | Lynn et al. | 200/5 |
| 4,128,744 | 12/1978 | Seeger | 200/5 |
| 4,143,253 | 3/1979 | Wagner et al. | 200/5 |
| 4,162,792 | 7/1979 | Chang et al. | 273/85 |
| 4,172,216 | 10/1979 | O'Shea | 200/85 |
| 4,264,477 | 4/1981 | Seeger et al. | 252/503 |
| 4,264,797 | 4/1981 | Parkinson | 200/159 B |
| 4,385,215 | 5/1983 | Lemberg | 200/159 B X |

*Primary Examiner*—E. A. Goldberg
*Assistant Examiner*—Morris Ginsburg
*Attorney, Agent, or Firm*—Merchant & Gould

[57] ABSTRACT

An improved membrane switch (10) is the subject matter of this patent. The switch (10) includes a pair of transparent, laminar contacts (16, 18) sandwiching a spacer (30) therebetween. The spacer (30) has a window (36) formed therein so that the contacts (16, 18) can be engaged at the location of the window (36) by the application of pressure to one of the contacts (16, 18). Engagement of the contacts (16, 18) closes a circuit to effect a desired function.

7 Claims, 6 Drawing Figures

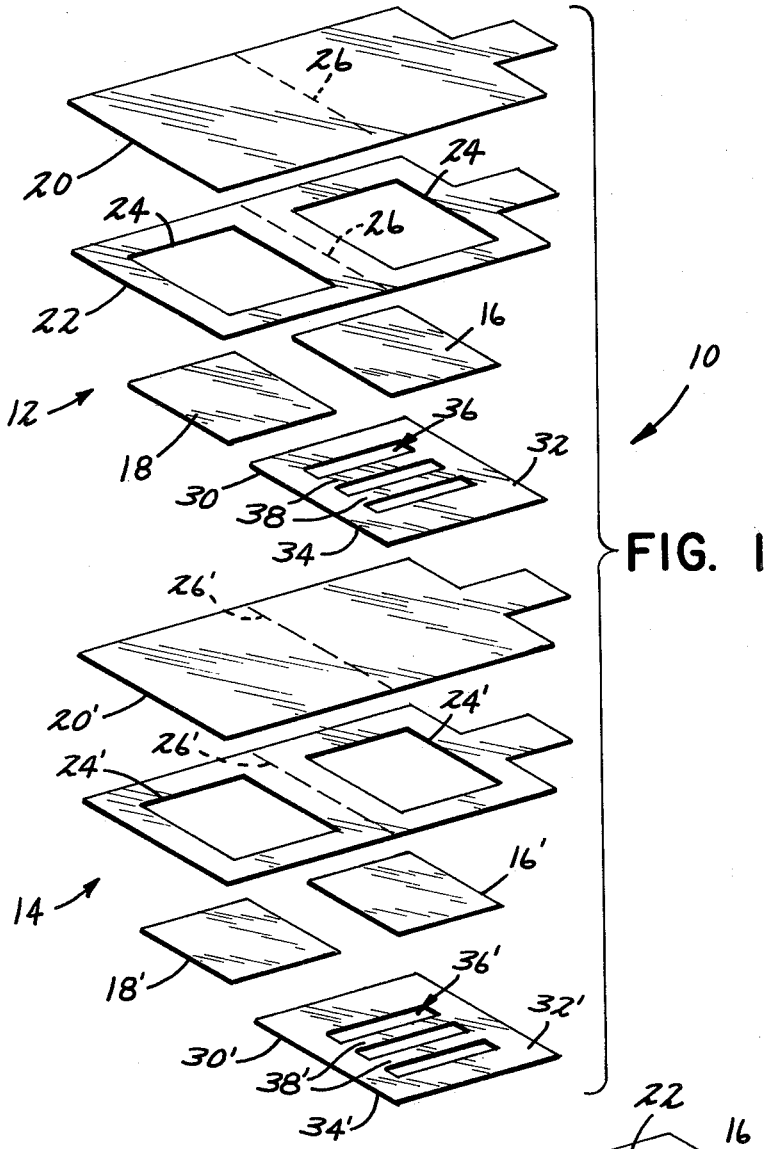
FIG. 1
FIG. 2
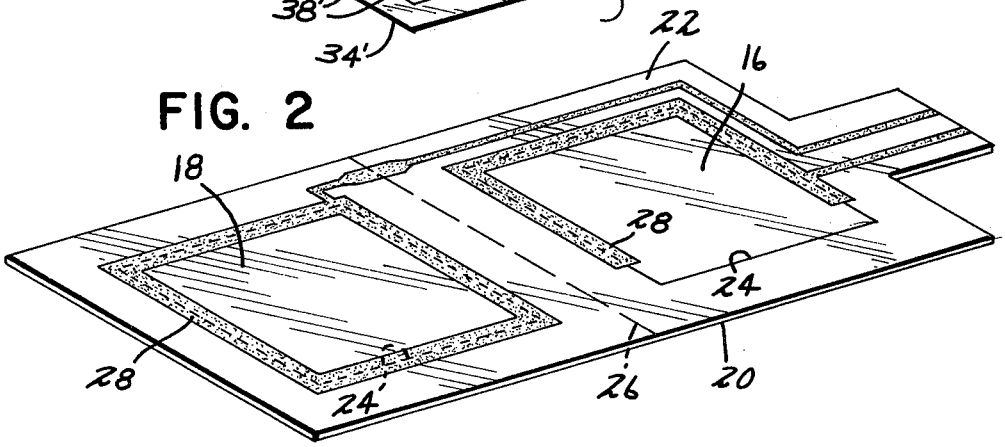

10
12
14
16
16'
18
18'
20
20'
22
22'
24
24'
26
26'
28
28'
30
30'
32
32'
34
34'
36
36'
38
38'
5
6

MEMBRANE SWITCH

TECHNICAL FIELD

The invention of the present application deals broadly with the field of membrane switches (e.g., switches wherein membranes either being conductive in themselves or having conductive networks screened thereon are brought into engagement with one another to close a circuit in order to effect a particular function). More specifically, the invention is directed to such a switch wherein the particular function to be effected by operation of the switch is illustrated on the switch itself by means of back lighting. The particular function illustration can, thereby, be displayed in a more appealing manner.

BACKGROUND OF THE INVENTION

Membrane switches, also known as tactile or pressure sensitive switches, typically include a pair of resilient laminae. Such laminae are frequently made from a polyester material. Each lamina has a silver conductive ink circuit screened on one side thereof, and the sides upon which the circuits are printed are facing proximately one another. The laminae are arranged so that the circuits will be superimposed on one another when the laminae are in engagement. A spacer, which can also be manufactured from a polyester material, is positioned intermediate the laminae and, in many instances, has a window cut out at the location of the silver conductive ink circuits in order to enable the circuits to be brought into engagement. The spacer can be secured to the laminae by a pressure sensitive adhesive.

Depending upon the thickness of the spacer, the size of the window can be varied while yet maintaining the laminae in a normally non-engaged relative positioning. When pressure is applied to the laminae, however, urging them together, the circuits screened onto the laminae are brought into engagement to close a switch and effect a function. The function which will be effected depends upon the application to which the switch is being put. Such switches can be used in keyboards for computers, controls for microwave ovens, and dispensing switches for vending machines. In this latter specific application, it is frequently desirable to back light the switch in order to make the display of the selection keys more attractive. When the switch is manufactured as known in the prior art, the silver conductive ink circuits screen printed onto the laminae preclude the usage of back lighting to illustrate the particular function. Since such traces are opaque, the indicia illustrated on the switch become distorted in view of the ink circuits applied to the laminae.

The invention of the present application is a membrane switch which solves the problems of the prior art as discussed above. It can be used with a back lighting method of representing indicia of the function to be effected without any distortion of the indicia being caused by the silver conductive ink circuit.

SUMMARY OF THE INVENTION

The invention of the present patent application is a membrane switch which, when closed, is designed to effect a particular function. An objective of the invention is to provide a membrane switch which can be used with back lighting so that selection indicia printed on a surface overlying the switch can be viewed without any obstruction or distortion which might be created by electrical conductive traces on switches known in the art. The switch in accordance with the present invention includes a spacer lamina having oppositely facing surfaces. The lamina defines a window within the bounds thereof. A first transparent, resilient circuit contact is disposed on one side of the spacer lamina and adjacent that side. The first contact extends across the window defined within the spacer lamina. A second transparent electrical circuit contact is disposed on a second side of the spacer lamina in engagement with the second surface of the lamina. The second contact also extends across the window, and the contacts can be brought into engagement within an area bounded by the window by the application of pressure to one or both of the contacts.

The contacts can be mounted within three mil thick polyester film supports by inlaying them within apertures cut to size within the polyester film. The contacts can be maintained within the apertures by laminating the contact/support assemblies to backings. Each of the backings can comprise a segment of two mil thick polyester film.

In applications to which the membrane switch can be put wherein it is necessary that the switch have a large area, means can be provided to preclude inadvertent engagement of one contact with the other because of the large dimension of the contacts, the resiliency of at least one of the contacts, and, in some cases, the relatively thin dimension of the spacer separating the contacts. A pair of switch networks similar in construction to the membrane switch hereinbefore described can be wired in parallel with windows defined within the spacer laminae in an overlying relationship. Each of the windows can be provided with a spacer bridge or bridges traversing the window. The bridges of one network can be staggered with respect to those of the other. That is, one bridge of one network can be disposed with respect to each and every bridge of the other network so that there is no overlapping. In a preferred embodiment, the bridges can be elongated and parallel along their axes of elongation, lateral edges of bridges of one network being immediately laterally adjacent lateral edges of bridges of the other network. A structure is thereby provided wherein, even though the switch contact engagement area extends over a large area, inadvertent engagement will be precluded even though actuation can be effeced by the application of pressure to one or both of the contacts at any location thereon. Even in this embodiment, indicia on a selection plate can be highlighted by use of back lighting.

The invention of the present application is, therefore, a structure which solves problems existent in the prior art and obtains many favorable advantages. More specific features and advantages obtained in view of those features will become apparent with reference to the detailed description of the invention, appended claims, and accompanying drawing figures.

BRIEF DESCRIPTION OF THE DRAWINGS

FIG. 1 is an exploded view, in perspective, of a membrane switch in accordance with the invention of the present application;

FIG. 2 is a perspective view of contact laminae of one switch network of the membrane switch of FIG. 1;

DETAILED DESCRIPTION OF THE INVENTION

Figures 3, 4, 5, 6:
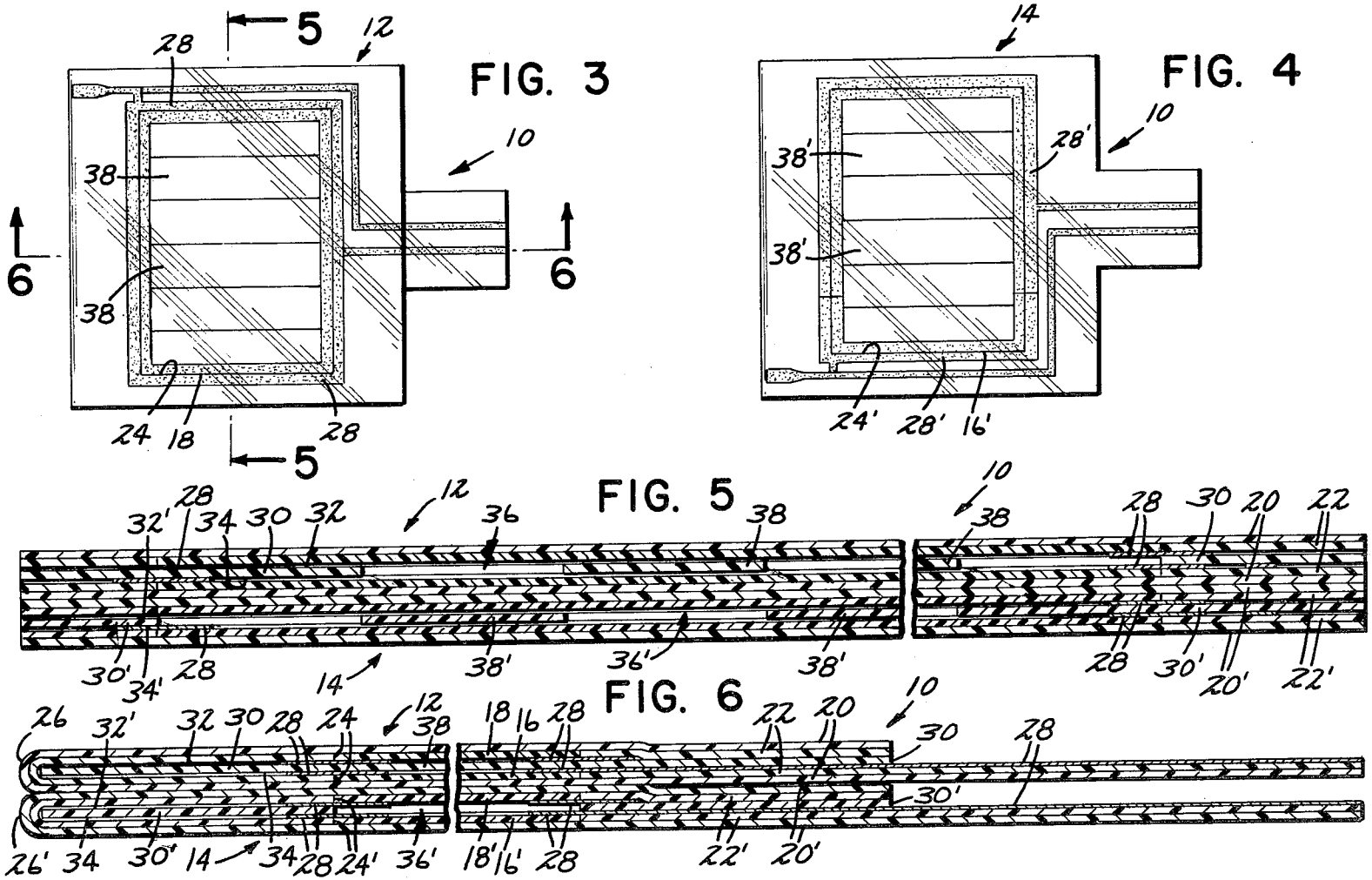
FIG. 3 is a plan view of the switch network illustrated in FIG. 2.
FIG. 4 is a plan view of a second switch network.
FIG. 5 is a sectional view taken generally along the line 5—5 of FIG. 3.
FIG. 6 is a sectional view taken generally along the line 6—6 of FIG. 3.

Referring now to the drawings wherein like reference numerals denote like elements throughout the several views, FIG. 1 illustrates, in an exploded perspective view, a membrane switch 10 in accordance with the invention of the present application. The switch 10 comprises, wired in parallel, two switch networks 12, 14. Portions of a first network 12 are illustrated in perspective in FIG. 2, and the first network 12 and second network 14 are illustrated in plan view in FIGS. 3 and 4, respectively.

Referring again to FIG. 1, each network includes a first contact 16, 16′ and a second contact 18, 18′. The contacts 16, 16′, 18, 18′ are shown as being laminar and are made of a transparent material. It is necessary that they not only be transparent, but also that they be electrically conductive. Research has revealed that a few materials function well for this purpose. Two which have been found to work satisfactorily are marketed under the trademarks INTREX K and SCOTCHTINT.

Since it is these contacts that, although normally held apart in a manner to be described hereinafter, effect closing of a switch to initiate operation of a function, it is necessary that at least one have a measure of resiliency. As tactile pressure is applied to urge the contacts together, the resiliency will allow deformation to accomplish engagement.

Means are provided for supporting the contacts in position with a surface of each infacing relation. This can be accomplished by applying a pressure sensitive adhesive to a polyester film backing 20 and laminating the contacts thereto. A support 22 can also be formed from a polyester film, and a portion of the film, similar in size and shape to the size and shape of the contacts, can be cut out as at 24. The supports 22 and 22′ can also be laminated to the backing 20 with the contacts 16, 16′, 18, 18′ inlaid within the cut out portions 24, 24′. The supports 22 and 22′ thereby provides further restriction of the contacts against lateral movement along the backing 20.

It has been found appropriate to use a polyester film having a thickness of two mils as the backing material and a polyester film having a thickness of three mils as the support material. Since the engagement surfaces of the contacts should be flush with surfaces of the supports 22, 22′, the particular conductive material used for the contacts can be also of a thickness of three mils.

The total five mil thickness of the support 22 and backing 20, in combination, will be small enough so that folding of the assembly, as at 26 is not precluded. It is this folding which allows the contacts to be brought so that their engagement surfaces are in a facing relationship.

As seen in FIG. 2, graphite conductive ink 28 can be screen printed around the border of the INTREX K or other contact material. It is through this screen circuit that a signal is conducted to the contacts. When the contacts are engaged, the circuit is completed.

A spacer lamina 30, 30′ is interposed between the facing surfaces of the contacts. A first surface 32, 32′ of the spacer lamina 30, 30′ is in engagement with a portion of the first contact, and a second surface 34, 34′ of the lamina 30, 30′ is in engagement with a portion of the second contact. The spacer lamina 30 is an insulative material and precludes engagement of the contacts except at areas of discontinuity therein.

The spacer lamina 30 has a window 36 formed within its periphery to allow at least one of the contacts which is resilient to be urged, within the area of the window 36, into engagement with the other contact. The window 36, optimally, is small enough so that the graphite conductive ink 28 printed on one portion of the support surface on a side of the fold 26 is insulated from the graphite conductive ink 28 printed on the portion of the support surface on the other side of the fold 26.

As seen particularly in FIGS. 1 and 5, the windows 36, 36′ in both the first and second switch networks 12, 14 can be traversed by at least one spacer bridge 38, 38′. The figures illustrate two bridges traversing the window of each network 12, 14.

The bridges 38, 38′ are elongated and parallel with respect to their axes of elongation. Although not essential, they are shown as being of equal width and spaced from one another at distances equal to their width.

Such a construction allows the bridges 38 of one network 12 to compliment those 38′ of the other network 14. That is, although the bridges 38 of one network 12, while reducing the total area over which the contacts in its network extend to preclude inadvertent engagement, obstruct portions of the contacts which can be engaged, the two contacts in the other network will be engaged at the locations of the first network bridges 38. Since the two networks 12, 14 are wired in parallel, pressure applied urging the contacts of the networks 12, 14 together will cause activation of one of the networks no matter at what point the pressure is applied. As can be seen, in moving across the contact engagement area, or the area within the perimeter of the window 36, a lateral edge of the bridge of one network is immediately laterally adjacent to the lateral edge of the next consecutive bridge in the other network. The bridges, thereafter, alternate across the area with lateral edges of consecutive bridges being immediately laterally adjacent.

A membrane switch as described herein solves numerous problems extant in the prior art. Not only does it obviate the presence of unsightly silver conductive traces on the switch contact area itself, which traces might obscure or obstruct viewing of indicia represented on the switch and highlighted by back lighting, but it also allows this feature to be obtained when the overall switch area is quite large. When the switch area is large, it also precludes inadvertent engagement of the contacts because of the inherent resiliency.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined by the language in which the appended claims are expressed.

What is claimed is:

1. A membrane switch, comprising:

(a) a spacer lamina having oppositely facing surfaces and defining a window therein;

(b) a first transparent, resilient electrical circuit contact adjacent a first of said surfaces and interposed in said window;

(c) a second transparent electrical circuit contact adjacent a second of said surfaces and interposed in said window;

(d) contact support mounting said contacts, wherein each contact is inlain within a segment of said support, having a surface for engaging the opposite of said contacts flush with a surface of said support in which it is inlain; and (e) conductive ink printed around said contacts and also printed on said support, forming borders around said contacts, wherein a signal may be conducted to said contacts.

2. A membrane switch in accordance with claim 1 wherein said first and second transparent contacts are laminar.

3. A membrane switch in accordance with claim 1 further comprising a planar backing to which each of said contacts and said support are laminated.

4. A membrane switch in accordance with claim 3 wherein said backing comprises segments of two mil thick polyester film.

5. The membrane switch in accordance with claim 1, wherein said support comprises segments of three mil thick polyester film.

6. A membrane switch, comprising:

(a) a first switch network including:

(i) a first laminar, transparent contact;

(ii) a second laminar, transparent contact facing said first contact;

(iii) a spacer, intermediate said first and second contacts, defining a window therein through which said contacts can engage; and (iv) at least one spacer bridge traversing said window; and (b) a second switch network including:

(i) a first laminar, transparent contact;

(ii) a second laminar, transparent contact facing said second network first contact;

(iii) a spacer, intermediate said second network first and second contacts, defining therein a window overlying said first network window, through which said second network contacts can engage; and (iv) at least one spacer bridge traversing said second network window; and (c) wherein said at least one first network spacer bridge is one of laterally adjacent and spaced from said at least one second network spacer bridge; and (d) wherein said first and second networks are wired in parallel to effect a desired function when contact of at least one network are engaged, wherein pressure applied urging said contacts of said first switch network together and urging said contacts of said second switch network together will cause activation of at least one of said first and second networks.

7. A membrane switch in accordance with claim 6 wherein said first and second spacer bridges have lateral edges and wherein said bridges of said first network alternate laterally across a contact engagement area defined by said first network window and said second network window, edges of consecutive bridges being immediately laterally adjacent.

* * * * *